US005868069A

United States Patent [19]

Khalid et al.

[11] Patent Number: 5,868,069

[45] Date of Patent: Feb. 9, 1999

[54] METHOD OF GENERATING PROOFS OF PRINT SIGNATURES

[75] Inventors: Najeeb Khalid, Westmount; Larrimore Adams, Montreal, both of Canada

[73] Assignee: Escher-Grad Technologies Inc., Quebec, Canada

[21] Appl. No.: 965,392

[22] Filed: Nov. 6, 1997

Related U.S. Application Data

[63] Continuation-in-part of Ser. No. 715,219, Sep. 17, 1996, Pat. No. 5,704,282.

[51] Int. Cl.[6] ..... B41J 15/06; B41J 2/525

[52] U.S. Cl. ..... 101/93.01; 101/93.11

[58] Field of Search ..... 101/93.01, 93.11, 101/93.12, 179, 181, 484, 485, 220, 221, 223; 347/4, 5, 172; 355/23, 24, 407, 408

[56] References Cited

U.S. PATENT DOCUMENTS

| | | | |
|---|---|---|---|
| 5,031,530 | 7/1991 | Burger | 101/180 X |
| 5,069,124 | 12/1991 | Schneider | 101/483 |

FOREIGN PATENT DOCUMENTS

| | | |
|---|---|---|
| 317762 | 5/1989 | European Pat. Off. . |
| 319223 | 10/1990 | European Pat. Off. . |
| 2605268 | 4/1988 | France . |

OTHER PUBLICATIONS

Escher–Grad Technologies Inc., Advertising leaflet on "TrueProofer", May 1995.

*Primary Examiner*—J. Reed Fisher
*Attorney, Agent, or Firm*—Foley & Lardner

[57] ABSTRACT

The invention relates to an apparatus for generating proofs of print signatures composed of first and second flats printed on opposite sides of a sheet comprises first and second digital printing units; a feeder mechanism for feeding a substrate having opposite sides to the first printing unit; a first input for feeding to the first printing unit digital data representative of an image of the first flat to imprint one side of the substrate with the image of the first flat; a marker for providing the substrate with a registration mark at a predetermined location on the substrate; a conveyor for conveying the imprinted substrate from the first printing unit to the second printing unit and feeding same thereto; and a mark sensor for detecting the location of the registration mark on the substrate and causing actuation of the second printing unit. The apparatus of the invention further includes a second input for feeding to the second printing unit digital data representative of an image of the second flat to imprint the other side of the substrate with the image of the second flat positioned with respect to the detected location of the registration mark such that the image of the second flat registers with the image of the first flat, thereby obtaining a proof of a print signature; and an outlet for discharging the proof of print signature from the second printing unit. Such an apparatus enables one to avoid generating films from the digital data representative of both flats and preparing a proof from such films.

21 Claims, 4 Drawing Sheets

METHOD OF GENERATING PROOFS OF PRINT SIGNATURES

This application is a continuation-in-part of application Ser. No. 08/715,219, filed Sep. 17, 1996, now U.S. Pat. No. 5,704,282.

BACKGROUND OF THE INVENTION

The present invention pertains to improvements in the field of offset lithography. More particularly, the invention is concerned with an apparatus for generating proofs of print signatures.

The process of offset printing from digitally generated information requires many steps that result in composite images and text on film. This film is used to make offset printing plates. The plates are then mounted on a printing press to produce multiple impressions on paper. Prior to committing the result of such a complex process to the press, that is to commence printing thousands of impressions, it is necessary to make one impression as a proof for obtaining approval of the customer prior to printing.

Printers print multiple page images on both sides of a large sheet of paper. Such a printed sheet is called a print signature. A single printed side, on the other hand, is called a flat. Thus, a print signature is composed of two flats printed on opposite sides of a sheet. The page images on each flat are positioned in a manner such that they are in the correct sequence after folding the print signature. The proof that a printer requires must have is the proof of the print signature.

Proofs of print signatures are prepared from the films, and if corrections have to be made, new films incorporating the necessary corrections have to be generated again. This results in extra manpower and cost of generating new films and new proofs for each and every iteration.

Technology has made it possible to generate offset printing plates directly without the intermediate steps of generating a film and then the plate from the film. This makes it impossible to generate proofs prior to printing. As most printers are unwilling to print without obtaining the approval of a proof by their customer, they are unable to use such a new technology.

SUMMARY OF THE INVENTION

It is therefore an object of the present invention to overcome the above drawbacks and to provide an apparatus for generating proofs of print signatures.

In accordance with the invention, there is thus provided an apparatus for generating proofs of print signatures composed of first and second flats printed on opposite sides of a sheet. The apparatus of the invention comprises:

first and second digital printing units;

means for feeding a substrate having opposite sides to the first printing unit;

first input means for feeding to the first printing unit digital data representative of an image of the first flat to imprint one side of the substrate with the image of the first flat;

marking means for providing the substrate with a registration mark at a predetermined location on the substrate;

conveyor means for conveying the imprinted substrate from the first printing unit to the second printing unit and feeding same thereto;

mark sensing means for detecting the location of the registration mark on the substrate and causing actuation of the second printing unit;

second input means for feeding to the second printing unit digital data representative of an image of the second flat to imprint the other side of the substrate with the image of the second flat positioned with respect to the detected location of the registration mark such that the image of the second flat registers with the image of the first flat, thereby obtaining a proof of a print signature; and outlet means for discharging the proof of print signature from the second printing unit.

According to a preferred embodiment of the invention, the first and second printing units are separate printing units with the first printing unit having outlet means for discharging the imprinted substrate and the second printing unit having inlet means for receiving the imprinted substrate discharged from the first printing unit. Preferably, the conveyor means comprises a bridge connecting the outlet means of the first printing unit with the inlet means of the second printing unit, whereby the imprinted substrate is conveyed from the first printing unit to the second printing unit by passing along the bridge. The first and second printing units each include an impression cylinder about which the substrate passes, the impression cylinder having a central longitudinal axis, means for rotating the impression roller about the longitudinal axis thereof and control means for controlling the rotation of the impression cylinder so as to provide the substrate with slack between the first printing unit and the second printing unit. Preferably an opening is formed in the bridge and a closure member is hinged to the bridge for movement between a closed position whereat the closure member closes the opening and an open position whereat the slacked substrate hangs from the bridge through the opening.

According to another preferred embodiment, the substrate is in the form of a continuous web and a web tracking control means is mounted on the bridge for maintaining the web along a predetermined path. Preferably, the web tracking control means comprises drift sensing means for detecting a lateral drift of the web and generating a drift signal representative of the lateral drift; signal processing means for processing the drift signal and generating a correction signal; and drift correction means for correcting the lateral drift of the web in response to the correction signal to maintain the web along the predetermined path.

According to a further preferred embodiment, the drift sensing means comprises a pivotable bell-crank having first and second arms with the first arm being urged against a lateral edge of the web, and first and second contact members disposed on either side of the second arm in spaced relation thereto, whereby a lateral drift of the web in one direction causes the first arm to pivotally move in the one direction and the second arm to pivotally move into contact engagement with the first contact member so that the aforesaid drift signal is representative of the lateral drift in the one direction, and a lateral drift of the web in the opposite direction causes the first arm to pivotally move in the opposite direction and the second arm to pivotally move into contact engagement with the second contact member so that the drift signal is representative of the lateral drift in the opposite direction.

According to yet another preferred embodiment, the drift correction means comprises first and second idler rollers extending parallel with one another, first and second biasing means associated respectively with first and second ends of the first idler roller for urging the first idler roller against the second idler roller to define a nip through which passes the web, and first and second pressure adjustment means associated respectively with the first and second biasing means for varying the pressure exerted by the first idler roller against the second idler roller at a selected end of the first idler roller in response to the correction signal. When the web laterally drifts in one direction the pressure is increased to cause the web to laterally drift in the opposite direction until the correction signal is null.

Preferably, each printing unit has a resolution ranging from about 300 to about 600 dots per inch, and the digital data is representative of the image of a flat at about 90,000 pixels per square inch.

The apparatus of the invention enables one to avoid generating films from the digital data representative of both flats and preparing a proof from such films.

BRIEF DESCRIPTION OF THE DRAWINGS

Further features and advantages of the invention will become more readily apparent from the following description of preferred embodiments as illustrated by way of examples in the accompanying drawings, in which.

DESCRIPTION OF PREFERRED EMBODIMENTS

Figure 1:
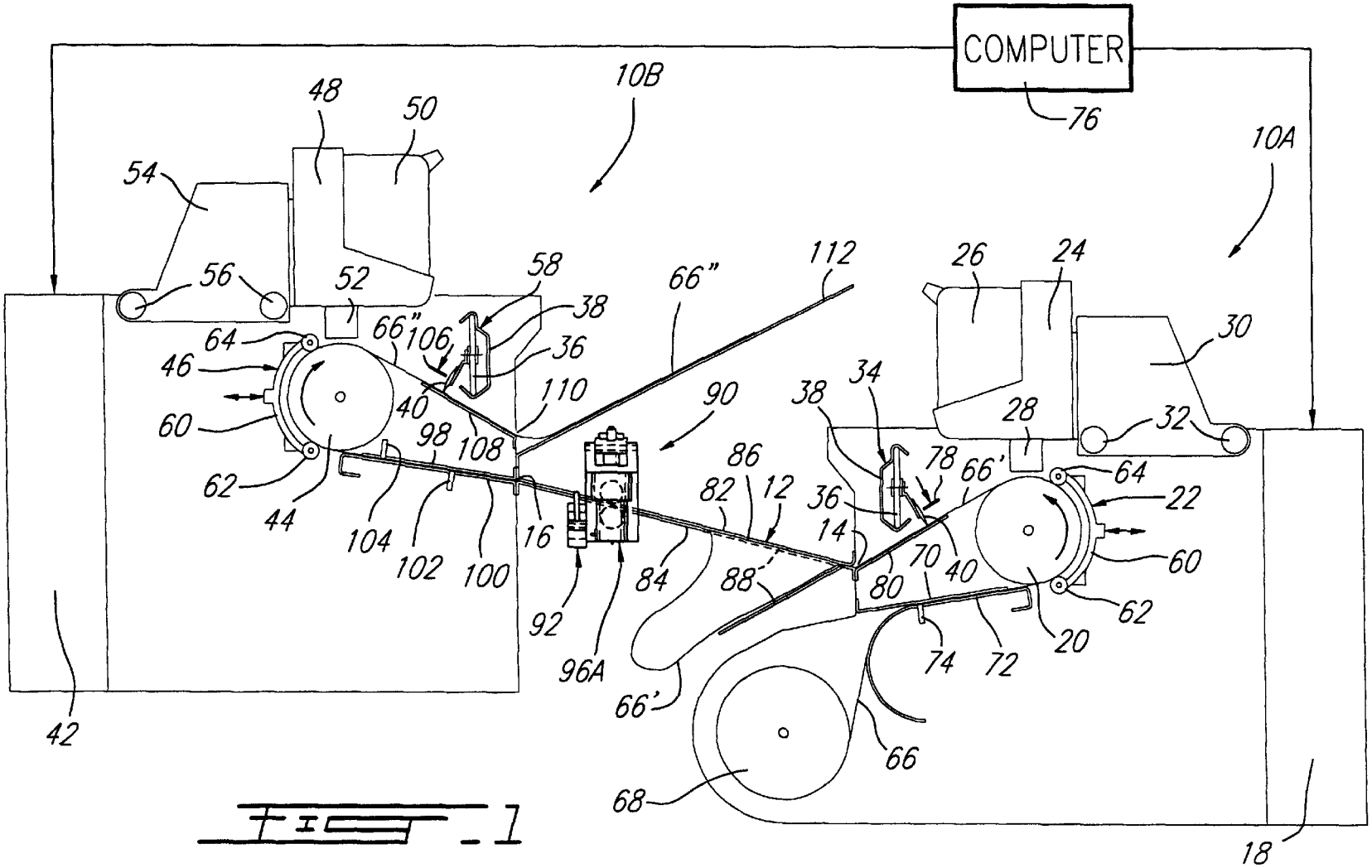
FIG. 1 schematically illustrates an apparatus for generating proofs of print signatures which incorporates a web tracking control device, according to a preferred embodiment of the invention.

As shown in FIG. 1, two digital printing units 10A and 10B are coupled together by a bridge 12 which connects the outlet 14 of unit 10A with the inlet 16 of unit 10B. Printing unit 10A comprises a control system 18, an impression cylinder 20, a movable paper guiding device 22, a cartridge holder 24 for holding a plurality of ink cartridges 26 (only one shown) of different colors, and a printing head 28 integral with the holder 24. The cartridge holder 24 in turn is mounted to a carriage 30 which is movable along guide rods 32 so as to displace the printing head 28 in a direction parallel to the rotation axis of the impression cylinder 20. The printing unit 10A further includes a paper cutting device 34 comprising a wheel 36 which is movable along a guide rail 38 and carries a rotatable disk blade 40. Similarly, the printing unit 10B comprises a control system 42, an impression cylinder 44, a movable paper guiding device 46, a cartridge holder 48 for holding a plurality of ink cartridges 50 (only one shown) of different colors, and a printing head 52 integral with the holder 48. The cartridge holder 48 is mounted to a carriage 54 which is movable along guide rods 56 so as to displace the printing head 52 in a direction parallel to the rotation axis of the impression cylinder 44. The printing unit 10B further includes a paper cutting device 58 which is identical to the device 34. The paper guiding devices 22 and 46 are also identical to one another and each comprise an arcuate member 60 and two idler rollers 62,64 rotatably mounted at the extremities of the member 60.

A continuous web 66 of paper is fed from a paper roll 68 to the printing unit 10A, between upper and lower guide members 70,72. An optical detector 74 is provided for detecting the leading edge of the paper web 66 so as to trigger, via the control system 18, rotation of the impression cylinder 20 and movement of the paper guiding device 22 in a direction away from the cylinder 20. After the paper web 66 has passed beyond the idler roller 62, the device 22 is moved in a direction towards the cylinder 20 to guide the paper web 66 around the cylinder and through the gap defined between the printing head 28 and the cylinder 20. The printing head 28 prints a registration mark on one side of the paper web 66 at a predetermined location, for example, in a margin next to the first line of one of the two flats to be printed on opposite sides of the web. Digital data representative of an image of the first flat is fed from the computer 76 to the printing head 28 via the control system 18 for imprinting one side of the paper web 66 with the image of the first flat. The imprinted paper web 66' then passes between a movable pressure plate 78 and a support plate 80 and then on the latter, exits the printing unit 10A through the outlet 14 thereof, and passes through the bridge 12 comprising top and bottom walls 82,84. The bottom wall 84 of the bridge 12 is provided with an opening 86 which is initially closed by a door 88 hinged to the wall 84.

A web tracking control device 90 is mounted on the bridge 12 for maintaining the imprinted paper web 66' along a predetermined path prior to entering the printing unit 10B. The device 90 comprises a drift sensor unit 92 for detecting a lateral drift of the web 66' and generating a drift signal representative of the lateral drift, a signal processing unit 94 (shown in FIG. 2) for processing the drift signal and generating a correction signal, and two drift correction units 96A and 96B (unit 96B being shown in FIG. 2) for correcting the lateral drift of the web 66' in response to the correction signal to maintain the web along the desired path.

The imprinted paper web 66' enters the printing unit 10B through the inlet 16 thereof and passes between upper and lower guide members 98 and 100. An optical detector 102 is provided for detecting the leading edge of the imprinted paper web 66' so as to trigger, via the control system 42, rotation of the impression cylinder 44 and movement of the paper guiding device 46 in a direction away from the cylinder 44. After the imprinted paper web 66' has passed beyond the idler roller 62, the device 46 is moved in a direction towards the cylinder 44 so that the web 66' is engaged between the cylinder 44 and roller 62. The door 88 is opened and rotation of the impression cylinder 44 is stopped for a period of time sufficient to provide the imprinted paper web 66' with slack, the slacked web 66' hanging from the bridge 12 through the opening 86, as shown in FIG. 1. Rotation of the cylinder 44 is then resumed. The imprinted paper web 66' is guided by the device 46 around the cylinder 44 and through the gap defined between the printing head 52 and the cylinder 44. Another optical sensor 104 is provided for detecting the location of the registration mark printed on the web 66' by the printing head 28.

After a period of time determined by the control system 42 has elapsed following detection of the registration mark, digital data representative of an image of the second flat is fed to the printing head 52 via the control unit 42 so as to imprint the other side of the paper web with the image of the second flat positioned with respect to the detected location of the registration mark such that the image of the second flat registers with the image of the first flat, thereby obtaining a proof 66" of a print signature. The proof 66" of print signature passes between a movable pressure plate 106 and a support plate 108 and then on the latter, exits the printing unit 10A through the outlet 110 thereof, and is discharged onto an inclined tray 112.

When a single proof 66" of a print signature is required, the imprinted paper web 66' is cut with the paper cutting device 34 of printing unit 10A. To this end, rotation of the impression cylinder 20 is stopped after the complete image of the first flat has been printed on one side of the paper web 66, the pressure plate 78 is moved to press the paper web against the support plate 80 and the paper web is cut with the disk blade 40, the other side of the paper web being imprinted with the image of the second flat by the printing head 52 of unit 10B. On the other hand, when several proofs of print signatures are required, the paper cutting device 58 of the printing unit 10B is used. After the complete image of the second flat has been printed, rotation of the impression cylinder 44 is temporarily stopped, the pressure plate 106 is moved to press the paper web against the support plate 108 and the paper web is cut with the disk blade 40 of device 58. The pressure plate 106 is then moved back to its initial position and rotation of the cylinder 44 is resumed for generating another proof of print signature.

Figure 2:
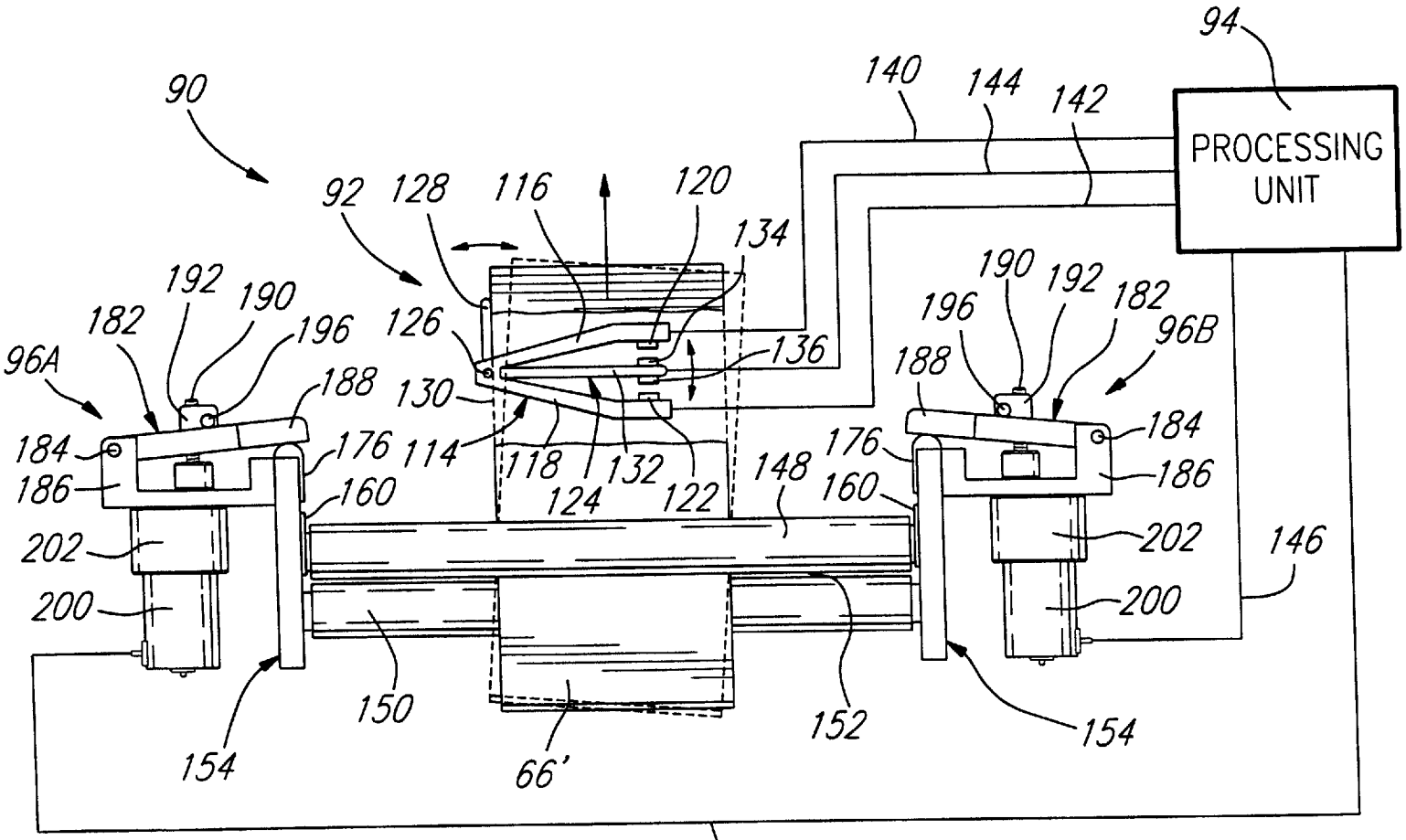
FIG. 2 schematically illustrates how the web tracking control device shown in FIG. 1 operates to maintain the web along a predetermined path.

As shown in FIG. 2, the drift sensor unit 92 comprises a V-shaped support member 114 made of an electrically non-conductive material and having two arms 116 and 118 which are provided with switch contacts 120 and 122, respectively. A bell-crank 124 made of an electrically conductive material is pivotally connected to the support member 114 by means of pivot pin 126. The arm 128 of the bell-crank 124 is urged against the lateral edge 130 of the web 66' by the weight of the other arm 132. The arm 132 is provided on either side thereof with switch contacts 134 and 136 adapted to engage the switch contacts 120 and 122, respectively. The switch contacts 120 and 122 are electrically connected to the processing unit 94 by leads 140 and 142, respectively. Switch contacts 134,136, on the other hand, are electrically connected to the processing unit 94 by lead 144. The processing unit 94 in turn is electrically connected to the drift correction units 96A and 96B by leads 145 and 146, respectively.

A lateral drift of the web 66' in a left direction causes the arm 128 to pivotally move in the left direction and the arm 132 to pivotally move upwardly, thereby bringing the switch contact 134 in engagement with the switch contact 120 and forming a closed circuit which generates a drift signal representative of the left lateral drift of the web 66'. A lateral drift of the web 66' in a right direction, on the other hand, causes the arm 128 to pivotally move in the right direction and the arm 132 to pivotally move downwardly, thereby bringing the switch contact 136 in engagement with the switch contact 122 and forming a closed circuit which generates a drift signal representative of the right lateral drift of the web 66'. The drift signal generated by the drift sensor unit 92 is processed by the processing unit which determines the direction of the lateral drift of the web 66' and transmits a correction signal to either the left or right drift correction unit 96A or 96B depending on whether the web 66' has drifted laterally in the left or right direction.

Figure 3:
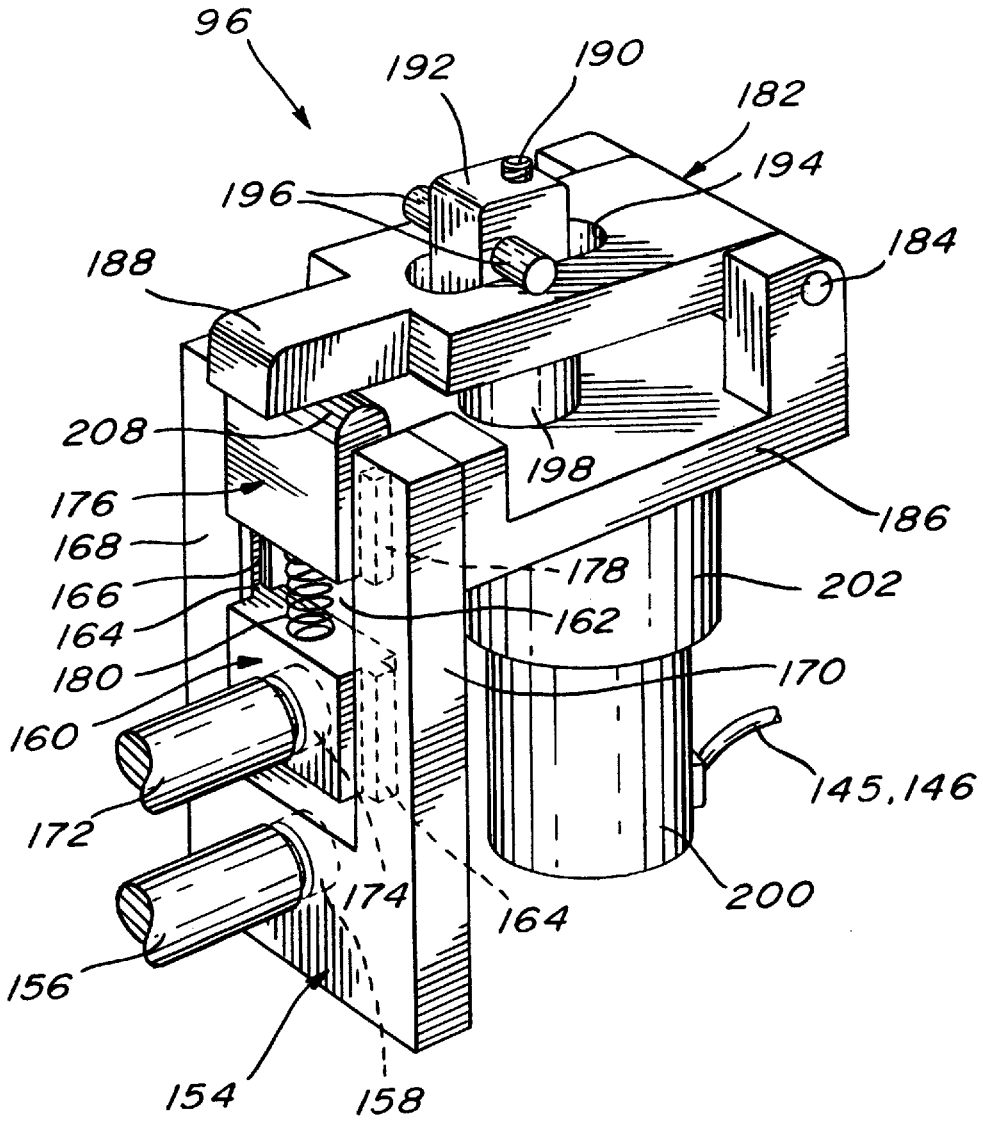
FIG. 3 is a fragmentary perspective view illustrating one of the two drift correction units used for correcting a lateral drift of the web.

Two idler roller 148 and 150 are arranged between the drift correction units 96A,96B. The roller 150 is rotatably mounted about a fixed rotational axis. The roller 148, on the other hand, is urged against the roller 150 to define a nip 152 through which passes the web 66'. As best shown in FIGS. 2 and 3, each drift correction unit 96 comprises a generally U-shaped plate member 154 to which is mounted the shaft 156 of roller 150, the shaft being journalled in bearing 158. A support member 160 is slidably mounted to the plate member 154 in the opening 162 formed therein for movement in a direction towards or away from the shaft 156, the support member 160 being provided with ribs 164 slidably engaged in grooves 166 (only one shown) defined in the legs 168,170 of the plate member 154. The shaft 172 of roller 148 is mounted to the support member 160 and journalled in bearing 174. Each unit 96 further includes a plunger member 176 which is slidably mounted to the plate member 154 in the opening 162 for movement in a direction towards or away from the support member 160, the plunger member 176 being also provided with ribs 178 (only one shown) slidably engaged in the grooves 166. A spring 180 is arranged under compression between the support member 160 and the plunger member 176.

Figure 4:
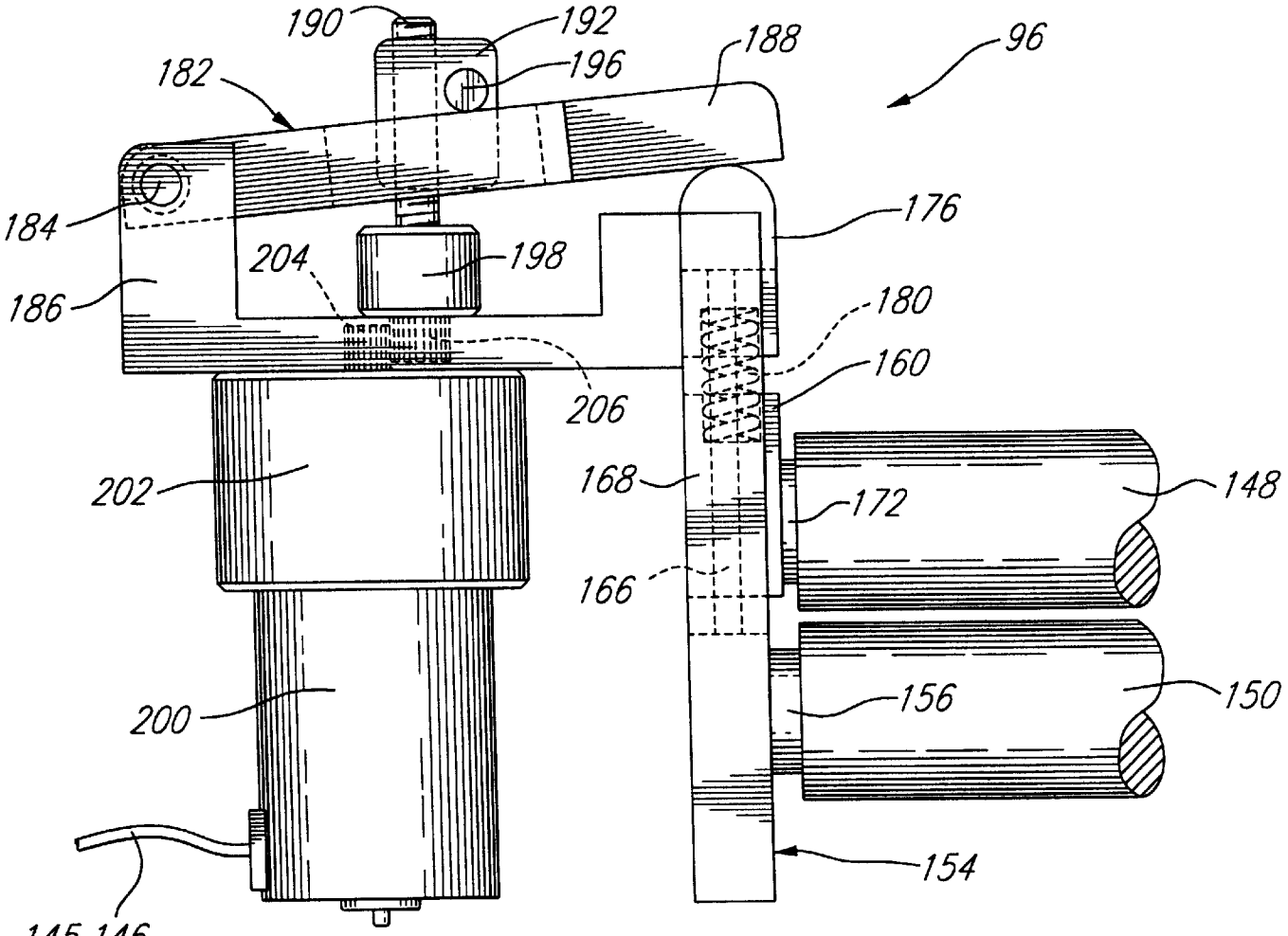
FIG. 4 is a fragmentary side elevational view illustrating the drift correction unit shown in FIG. 3.

A lever arm 182 is pivotally connected by pivot pins 184 to a bracket 186 which is fixed to the legs 168,170 of the plate member 154, the lever arm 182 having a free end portion 188 contacting the plunger member 176. The spring 180 of each unit 96 urges the roller 148 against the roller 150 and also urges the plunger member 176 against the end portion 188 of the lever arm 182. An adjustable screw member 190 is threadably engaged with an internally threaded member 192 which extends through a slot 194 defined in the lever arm 182 and is connected to the arm 182 by means of two abutment members 196 cooperating with the spring 180 to maintain the threaded member 192 and lever arm 182 connected together. The screw member 190 extends through a bushing 198 fixed to the bracket 186 and into an opening formed therethrough, as best shown in FIG. 4. A motor 200 provided with a gear box 202 fixed to the bracket 186 is coupled to the screw member 190 by means of a gear 204 keyed to the drive shaft (not shown) of motor 200 and meshing with a gear 206 keyed to the screw member 190, for rotating the screw member 190 to adjustably displace the threaded member 192 downwardly or upwardly. Displacement of the member 192 causes the lever arm 182 to pivotally move, thereby adjustably moving the plunger member 176 towards or away from the support member 160. Movement of the plunger member 176 in turn causes the support member 160 to move towards or away from the shaft 156 of roller 150, thereby adjustably varying the pressure exerted by the roller 148 against the roller 150 at a selected end of the roller 148. As shown, the plunger member 176 has a rounded top surface 28 to minimize the friction between the end portion 188 of lever arm 182 and the plunger member 176.

When the web 66' laterally drifts in a left direction, the drift signal generated by the drift sensor unit 92 and representative of such a left lateral drift is processed by the processing unit 94 which transmits a correction signal to the left drift correction unit 96A so as to activate the motor 200 and move the support member 160 towards the shaft 156 of roller 150, thereby increasing the pressure exerted by the roller 148 against the roller 150 at the left end and causing the web 66' to laterally drift in the right direction until the correction signal is null, that is, until the switch contacts 120,134 are disengaged. On the other hand, when the web 66' laterally drifts in a right direction, the drift signal generated by the drift sensor unit 92 and representative of such a right lateral drift is processed by the processing unit 94 which transmits a correction signal to the right drift correction unit 96B so as to activate the motor 200 and move the support member 160 towards the shaft 156 of roller 150, thereby increasing the pressure exerted by the roller 148 against the roller 150 at the right end and causing the web 661 to laterally drift in the left direction until the correction signal is null, that is, until the switch contacts 122,136 are disengaged. The web tracking control unit 90 thus enables the web 66' to be maintained along a predetermined path.

We claim:

1. An apparatus for generating proofs of print signatures composed of first and second flats printed on opposite sides of a sheet, comprising:

first and second digital printing units;

means for feeding a substrate having opposite sides to said first printing unit;

first input means for feeding to said first printing unit digital data representative of an image of said first flat to imprint one side of said substrate with the image of said first flat;

marking means for providing said substrate with a registration mark at a predetermined location on said substrate;

conveyor means for conveying the imprinted substrate from said first printing unit to said second printing unit and feeding same thereto;

mark sensing means for detecting the location of said registration mark on said substrate and causing actuation of said second printing unit;

second input means for feeding to said second printing unit digital data representative of an image of said second flat to imprint the other side of said substrate with the image of said second flat positioned with respect to the detected location of said registration mark such that the image of said second flat registers with the image of said first flat, thereby obtaining a proof of a print signature; and outlet means for discharging said proof of print signature from said second printing unit.

2. An apparatus as claimed in claim 1, wherein said first and second printing units are separate printing units with said first printing unit having outlet means for discharging the imprinted substrate and said second printing unit having inlet means for receiving the imprinted substrate discharged from said first printing unit, and wherein said conveyor means comprises a bridge connecting the outlet means of said first printing unit with the inlet means of said second printing unit, whereby the imprinted substrate is conveyed from said first printing unit to said second printing unit by passing along said bridge.

3. An apparatus as claimed in claim 1, wherein said first and second printing units each include an impression cylinder about which said substrate passes, said impression cylinder having a central longitudinal axis, means for rotating said impression roller about the longitudinal axis thereof and control means for controlling the rotation of said impression cylinder so as to provide said substrate with slack between said first printing unit and said second printing unit.

4. An apparatus as claimed in claim 2, wherein said first and second printing units each include an impression cylinder about which said substrate passes, said impression cylinder having a central longitudinal axis, means for rotating said impression roller about the longitudinal axis thereof and control means for controlling the rotation of said impression cylinder so as to provide said substrate with slack between said first printing unit and said second printing unit.

5. An apparatus as claimed in claim 4, wherein an opening is formed in said bridge and a closure member is hinged to said bridge for movement between a closed position whereat said closure member closes said opening and an open position whereat the slacked substrate hangs from said bridge through said opening.

6. An apparatus as claimed in claim 2, wherein said substrate is in the form of a continuous web and a web tracking control means is mounted on said bridge for maintaining said web along a predetermined path.

7. An apparatus as claimed in claim 6, wherein said web tracking control means comprises:

drift sensing means for detecting a lateral drift of said web and generating a drift signal representative of said lateral drift;

signal processing means for processing said drift signal and generating a correction signal; and drift correction means for correcting the lateral drift of said web in response to said correction signal to maintain said web along said predetermined path.

8. An apparatus as claimed in claim 7, wherein said drift sensing means comprises a pivotable bell-crank having first and second arms with said first arm being urged against a lateral edge of said web, and first and second contact members disposed on either side of said second arm in spaced relation thereto, whereby a lateral drift of said web in one direction causes said first arm to pivotally move in said one direction and said second arm to pivotally move into contact engagement with said first contact member so that said drift signal is representative of said lateral drift in said one direction, and a lateral drift of said web in a direction opposite to said one direction causes said first arm to pivotally move in the opposite direction and said second arm to pivotally move into contact engagement with said second contact member so that said drift signal is representative of said lateral drift in said opposite direction.

9. An apparatus as claimed in claim 7, wherein said drift correction means comprises first and second idler rollers extending parallel with one another, first and second biasing means associated respectively with first and second ends of said first idler roller for urging said first idler roller against said second idler roller to define a nip through which passes said web, and first and second pressure adjustment means associated respectively with said first and second biasing means for varying the pressure exerted by said first idler roller against said second idler roller at a selected one of said first and second ends in response to said correction signal, whereby when said web laterally drifts in one direction said pressure is increased to cause said web to laterally drift in a direction opposite to said one direction until said correction signal is null.

10. An apparatus as claimed in claim 9, wherein said second idler roller is rotatably mounted about a fixed rotational axis, said first idler roller is mounted between a pair of opposite support members each being slidable towards or away from said second idler roller, a plunger member being spaced from each said support member and slidable towards or away therefrom, and wherein said first and second biasing means each comprise a spring member arranged under compression between said support member and said plunger and said first and second pressure adjustment means each comprise means for adjustably moving said plunger member towards or away from said support member to thereby move said support member towards or away from said second idler roller and vary the pressure exerted by said first idler roller against said second idler roller at said selected one end.

11. An apparatus as claimed in claim 10, wherein said second idler roller is mounted between a pair of opposite plate members each having an opening formed therein, each said support member is slidably mounted to a respective plate member in the opening thereof, and wherein each said plunger member is slidably mounted to said respective plate member in said opening.

12. An apparatus as claimed in claim 11, wherein each said means for adjustably moving said plunger member towards or away from said support member comprises a lever arm contacting at one end thereof said plunger member and pivotally connected at another end thereof to a bracket member fixed to said respective plate member, for pivotal movement about a pivot axis extending parallel to said respective plate member, and means for pivotally moving said lever arm to adjustably move said plunger towards or away from said support member, said spring member urging said plunger member against said lever arm to retain said plunger member in contact engagement with said lever arm.

13. An apparatus as claimed in claim 12, wherein each said means for pivotally moving said lever arm comprises adjustable screw means threadebly engaged with an internally threaded member connected to said lever arm intermediate the ends thereof, and drive means mounted to said bracket member for rotating said screw means to adjustably displace said threaded member.

14. An apparatus as claimed in claim 13, wherein said threaded member extends through an opening defined in said lever arm and is provided with an abutment member cooperating with said spring member to maintain said threaded member and said lever arm connected together.

15. An apparatus as claimed in claim 1, wherein said marking means is a printing means for printing said registration mark on said one side of said substrate.

16. An apparatus as claimed in claim 1, wherein said mark sensing means comprises an optical detector.

17. An apparatus as claimed in claim 1, wherein said substrate is in the form of a continuous web and a web cutting means is arranged between said first printing unit and said second printing unit for cutting said web downstream of said first printing unit.

18. An apparatus as claimed in claim 1, wherein said substrate is in the form of a continuous web and a web cutting means is arranged between said second printing unit and said outlet means for cutting said web downstream of said second printing unit.

19. An apparatus as claimed in claim 1, wherein each said printing unit has a resolution ranging from about 300 to about 600 dots per inch.

20. An apparatus as claimed in claim 1, wherein said digital data is representative of the image of a flat at about 90,000 pixels per square inch.

21. An apparatus for generating proofs of print signatures composed of first and second flats printed on opposite sides of a sheet, comprising:

first and second digital printing units;

a feeder for feeding a substrate having opposite sides to said first printing unit;

a first input to provide to said first printing unit digital data representative of an image of said first flat to imprint one side of said substrate with the image of said first flat;

a marker for printing said substrate with a registration mark at a predetermined location on said substrate;

a conveyor for conveying the imprinted substrate from said first printing unit to said second printing unit and feeding same thereto;

a mark sensor for detecting the location of said registration mark on said substrate and causing actuation of said second printing unit;

a second input to provide to said second printing unit digital data representative of an image of said second flat to imprint the other side of said substrate with the image of said second flat positioned with respect to the detected location of said registration mark such that the image of said second flat registers with the image of said first flat, thereby obtaining a proof of a print signature; and an outlet for discharging said proof of print signature from said second printing unit.

* * * * *

UNITED STATES PATENT AND TRADEMARK OFFICE

CERTIFICATE OF CORRECTION

PATENT NO. : 5,868,069

DATED : February 9, 1999

INVENTOR(S) : Najeeb Khalid, et. al.

It is certified that error appears in the above-identified patent and that said Letters Patent is hereby corrected as shown below:

Title page, item [54] and col. 1, the title should read as following:

--APPARATUS FOR GENERATING PROOFS OF PRINT SIGNATURES--.

Signed and Sealed this

Twenty-fourth Day of August, 1999

*Attest:*

Q. TODD DICKINSON

*Attesting Officer*

*Acting Commissioner of Patents and Trademarks*